US010910184B2

(12) United States Patent
Takahashi et al.

(10) Patent No.: US 10,910,184 B2
(45) Date of Patent: Feb. 2, 2021

(54) SEALED RELAY

(71) Applicant: MEIDENSHA CORPORATION, Tokyo (JP)

(72) Inventors: Daizo Takahashi, Numazu (JP); Toshimasa Fukai, Shizuoka (JP); Masahiko Ieda, Mishima (JP)

(73) Assignee: MEIDENSHA CORPORATION, Tokyo (JP)

( * ) Notice: Subject to any disclaimer, the term of this patent is extended or adjusted under 35 U.S.C. 154(b) by 296 days.

(21) Appl. No.: 16/020,320

(22) Filed: Jun. 27, 2018

(65) Prior Publication Data

US 2018/0308651 A1 Oct. 25, 2018

Related U.S. Application Data

(62) Division of application No. 14/896,035, filed as application No. PCT/JP2014/064103 on May 28, 2014, now abandoned.

(30) Foreign Application Priority Data

Jun. 6, 2013 (JP) ..... 2013-119363

(51) Int. Cl.
*H01H 1/66* (2006.01)
*H01H 51/29* (2006.01)
(Continued)

(52) U.S. Cl.
CPC ..... *H01H 51/29* (2013.01); *H01H 50/02* (2013.01); *H01H 50/023* (2013.01);
(Continued)

(58) Field of Classification Search
CPC ..... H01H 51/29; H01H 50/02; H01H 50/023; H01H 1/5822
(Continued)

(56) References Cited

U.S. PATENT DOCUMENTS 3,205,332 A * 9/1965 Price ..... H01H 1/14 200/239
3,562,682 A 2/1971 Eatsuo Ohwada et al.
(Continued)

FOREIGN PATENT DOCUMENTS

JP 59-203326 A 11/1984
JP 64-84533 A 3/1989
(Continued)

OTHER PUBLICATIONS

Chinese Office Action, dated Oct. 8, 2016, 6 pages.
USPTO Notice of Allowance, U.S. Appl. No. 14/896,045, dated Oct. 28, 2016.

*Primary Examiner* — Alexander Talpalatski
(74) *Attorney, Agent, or Firm* — Foley & Lardner LLP

(57) ABSTRACT

In case of using multi-contacts or flat braided wires for constituting a current carrying structure of a movable part in a vacuum relay, problems tend to appear, which are enlargement of a control mechanism, complication, increased operation force and the like. The vacuum relay 1 includes an insulating cylinder 2, a first relay connecting portion 4 that is connected to one open end of the insulating cylinder 2 and has on its inner surface a first contact 3, a second relay connecting portion 5 that is arranged in the insulating cylinder 2 to face the first relay connecting portion 4, a movable member 7 that is movably arranged between the first and second relay connecting portions 4 and 5 and has a second contact that is brought into contact with the first contact when the movable member is moved toward the first relay connecting portion, and a control mechanism 8 that moves the movable member 7 in both directions to establish and break the contact between the two contacts. Between the movable member 7 and the second relay connecting portion 5, there is provided a bellows 11 through which the movable
(Continued)

member 7 and the second relay connecting portion 5 are electrically connected.

16 Claims, 2 Drawing Sheets

(51) Int. Cl.
*H01H 50/02* (2006.01)
*H01H 1/58* (2006.01)
*H01H 33/662* (2006.01)

(52) U.S. Cl.
CPC ..... *H01H 1/5822* (2013.01); *H01H 33/66238* (2013.01); *H01H 2050/025* (2013.01)

(58) Field of Classification Search
USPC ..... 335/151
See application file for complete search history.

(56) References Cited

U.S. PATENT DOCUMENTS 3,582,587 A * 6/1971 Barkan ..... H01H 33/666 218/120
3,594,754 A * 7/1971 Voshall ..... H01H 33/668 340/605
3,843,856 A 10/1974 Attia
3,909,676 A * 9/1975 McConnell ..... H01H 33/59 361/135
4,272,661 A * 6/1981 Dethlefsen ..... H01H 33/666 218/142
4,464,642 A * 8/1984 Yamagata ..... H01H 73/04 218/146
5,191,180 A * 3/1993 Kitamura ..... H01H 33/666 218/135
5,892,194 A 4/1999 Uotome et al.
6,144,005 A * 11/2000 Tanimizu ..... H01H 31/003 218/118
6,268,995 B1 * 7/2001 Beuerman ..... H01G 5/00 361/277
6,587,328 B2 * 7/2003 Bigler ..... H01G 5/00 361/279
6,884,940 B1 * 4/2005 Utsumi ..... H01H 31/003 174/542
7,041,930 B2 * 5/2006 Takahashi ..... H01G 5/14 218/135
2002/0043516 A1 * 4/2002 Morita ..... H01H 33/66207 218/118
2005/0162807 A1 * 7/2005 Takahashi ..... H01G 5/14 361/277
2006/0266739 A1 * 11/2006 Takahashi ..... H01G 5/14 218/136
2010/0224472 A1 9/2010 Horikoshi et al.
2011/0067986 A1 * 3/2011 Fleck ..... H01H 33/6606 200/237
2012/0044030 A1 2/2012 Wu
2012/0187090 A1 * 7/2012 Grosjean ..... H01H 33/6661 218/140
2012/0319806 A1 12/2012 Mills et al.
2013/0057369 A1 3/2013 Yano et al.
2013/0075368 A1 * 3/2013 Marchand ..... H01H 33/664 218/140
2013/0342292 A1 12/2013 Choi et al.
2015/0084721 A1 3/2015 Ziegler et al.
2016/0133419 A1 5/2016 Takahashi et al.

FOREIGN PATENT DOCUMENTS

JP 01-204322 A 8/1989
JP 10-284347 A 10/1998
JP 10-340655 A 12/1998
JP 2002-313197 A 10/2002
JP 2005-259543 A 9/2005
JP 2006-172847 A 6/2006
JP 2006-332388 A 12/2006
JP 2009-004607 A 1/2009
JP 2009-076218 A 4/2009

* cited by examiner

SEALED RELAY

CROSS REFERENCE TO RELATED APPLICATIONS

This application is a divisional of U.S. application Ser. No. 14/896,035, filed Dec. 4, 2015, which is the National Phase Application of PCT/JP2014/064103, filed May 28, 2014, which claims benefit of priority from the prior Japanese Application No. 2013-119363, filed Jun. 6, 2013; the entire contents of all of which are incorporated herein by reference.

TECHNICAL FIELD

The present invention relates to a sealed relay, such as a vacuum relay that effects an electric connection to an external circuit through a current carrying path including a bellows or an insulation gas sealed relay that is hermetically sealed to enclose an insulation gas such as $SF_6$ (sulfur hexafluoride) gas, dry air or the like.

BACKGROUND ART

Sealed relays in these days, for example, commercially available vacuum relays are almost of a type that makes ON/OFF switching between contact points with the aid of a magnetic field produced by a coil. However, this type relay can't handle or carry a large current.

In view of the above, usage of construction of a VI (vacuum interrupter=vacuum valve) employed in blockers of a power system has been proposed.

The VI is so constructed that, for carrying a large current of several hundred A (for example, rated current 600 A, rated breaking current 20 kA), a movable shaft and multi-contacts connected to the movable shaft are used or connection to an external circuit is made through flexible flat braided wires or the like (for example, the devices shown in Prior Art Documents 1, 2 and 3).

PRIOR ART DOCUMENTS

Patent Documents

Patent Document 1: Japanese Laid-open Patent Application (tokkai) 2009-76218

Patent Document 2: Japanese Laid-open Patent Application (tokkai) 2006-172847

Patent Document 3: Japanese Laid-open Patent Application (tokkai) 2005-259543

SUMMARY OF INVENTION

Problems to be Solved by Invention

However, in case of carrying current to the external circuit by using a path similar to the VI, the vacuum relays have the following drawbacks.

(1) In case of using the multi-contacts or the flat braided wires in order to make the current carrying construction of the movable side portion, drawbacks, such as increasing in size, complication, increasing in operation force and the like, are caused.

(2) In case of a RF (high frequency) current carrying in which the current carrying is restricted by a skin effect, the current carrying by using the movable member and multi-contacts or the like inevitably needs an extreme increasing of the diameter of the movable member when it is intended to carry a large current.

(3) For producing the movable shaft, it is necessary to use a high conductive material, such as copper alloy or the like.

In a vacuum relay of the present invention, the above-mentioned problems of known examples are eliminated by carrying a current with the use of bellows.

Means for Solving the Problems

In at least one embodiment of this specification, there is provided a sealed relay which includes an insulating cylinder, a first relay connecting portion that is connected to one open end of the insulating cylinder and has on its inner surface a first contact, a second relay connecting portion that is arranged to face the first relay connecting portion leaving a given distance therebetween, a movable member that is movably arranged between the first and second relay connecting portions and has a second contact that is brought into contact with the first contact when the movable member is moved toward the first relay connecting portion, and a control mechanism that moves the movable member in both a direction to establish the contact between the two contacts and the other direction to break the contact between the two contacts, so that by contacting the first and second contacts by driving the movable member by the control mechanism, the first and second relay connecting portions are electrically connected through the movable member, which is characterized in that a bellows is provided between the movable member and the second relay connecting portion to electrically connect the movable member and the second relay connecting portion.

In at least one embodiment of this specification, which is further characterized in that the bellows is of a double structure type including an inner bellows and an outer bellows, the inner bellows having a hermetically sealing function and the outer bellows having a current carrying function.

In at least one embodiment of this specification the control mechanism comprises an air cylinder.

Effects of Invention (1) In the vacuum relay of at least one embodiment of this specification, when the first and second contacts are brought into contact with each other due to movement of the movable member toward the first relay connecting portion, the first and second relay connecting portions are electrically connected through the bellows.

Since the surface area of the bellows is large as compared with that of the multi-contacts or the like, the present invention is advantageous in a large current carrying of the RF (high frequency) current carrying.

In the invention, the control mechanism can be reduced in size, simplified and reduced in operation force as compared with that employed in cooperation with the multi-contacts or that employed in cooperation with the flat braided wires.

Furthermore, since the current carrying is made through the bellows, there is no need of using a high conductive material, such as copper alloy or the like, for producing the movable shaft.

(2) In the sealed relay of at least one embodiment of this specification, the hermetically sealing inner bellows keeps the interior of the insulating cylinder in a vacuum condition and the current carrying outer bellows electrically connects the movable member and the second relay connecting portion. Since the hermetically sealing bellows is arranged inside, operation force can be reduced.

(3) In the sealed relay of at least one embodiment of this specification, an air cylinder is used as an element of the control mechanism. Accordingly, even when erosion (abrasion) of the contacts appears, the contact pressure can be kept constant so long as the erosion is within the stroke of the air cylinder. In a known breaking control mechanism, a spring mechanism or the like is employed for producing the contact pressure in case where the contact pressure is reduced due to the erosion of the contacts. Thus, the known breaking control mechanism is large in size. However, in the embodiment, due to an air pressure of the air cylinder, the contact pressure can be kept and thus reduction in size can be achieved.

EMBODIMENT OF INVENTION

In the following, an embodiment of the present invention will be described with reference to FIG. 1.

Figure 1:
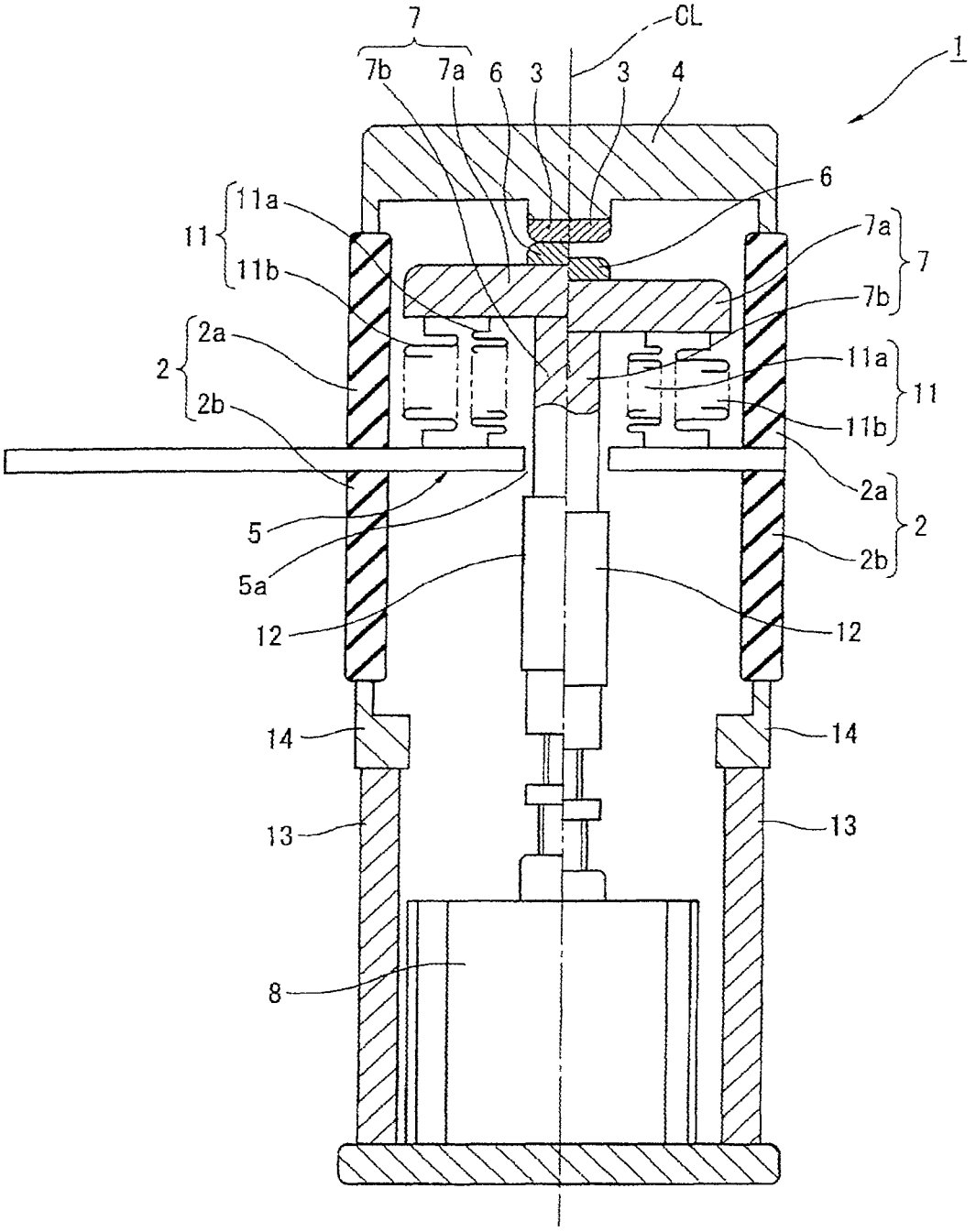
FIG. 1 is a sectional view of a sealed relay of the present invention, in which a left-half part from a center line CL shows a contact condition wherein first and second contacts are in contact with each other and a right-half part from the center line shows a non-contact condition wherein the first and second contacts are not in contact with each other.

In FIG. 1, denoted by numeral 1 is a vacuum relay that is an example of sealed relays. The vacuum relay 1 comprises an insulating cylinder 2, a first relay connecting portion 4 that is connected to one open end of the insulating cylinder 2 and equipped at its inner surface with a first contact (electrode) 3, a second relay connecting portion 5 that is arranged in the insulating cylinder 2 in a manner to face against the first relay connecting portion 4 while leaving a given distance therebetween, a movable member 7 that is movably arranged between the first relay connecting portion 4 and the second relay connecting portion 5 and has a second contact 6 that is brought into contact with the first contact 3 when the movable member 7 is moved toward the first relay connecting portion 4 and a control mechanism 8 that moves the movable member 7 in both a direction to establish the contact between the first and second contacts 3 and 6 and the other direction to break the contact between the first and second contacts 3 and 6 selectively.

Between the movable member 7 and the second relay connecting portion 5, there is disposed a retractable bellows 11.

The bellows 11 is of a double structure type including an inner bellows 11*a* and an outer bellows 11*b*, and the inner bellows 11*a* functions to keep the interior of the insulating cylinder 2 in a vacuum condition and the outer bellows 11*b* functions to electrically connect the movable member 7 and the second relay connecting portion 5. (In the following, the inner bellows 11*a* will be referred to as a hermetic sealing bellows and the outer bellows 11*b* will be referred to as a current carrying bellows). If desired, the bellows 11 may be of a single structure, not the double structure, which functions to effect both the hermetic sealing and the current carrying.

In the following, the insulating cylinder 2, first relay connecting portion 4, second relay connecting portion 5, control mechanism 8 and bellows 11 will be described in detail.

The insulating cylinder 2 is divided into first and second cylinder members 2*a* and 2*b*, and these cylinder members are made of ceramics.

The first relay connecting portion 4 is shaped into a circular plate and hermetically connected to an upper open end of the first cylinder member 2*a*. At a center portion of a lower surface of the first relay connecting portion 4, there is provided the first contact 3.

The second relay connecting portion 5 is tightly sandwiched between the first cylinder member 2*a* and the second cylinder member 2*b*. At a center part (viz., a portion that corresponds to a center part of the insulating cylinder 2) of the second relay connecting portion 5, there is formed a shaft portion receiving hole 5*a* for receiving therein a shaft portion 7*b* of a next-mentioned movable member 7.

The movable member 7 comprises a circular flange portion 7*a* that has at a center part of an upper surface thereof the second contact 6 and a shaft portion 7*b* that is provided at a center of a lower surface of the circular flange portion 7*a* and has a diameter smaller than that of the circular flange portion 7*a*. The flange portion 7*a* is made of a high conductive material such as copper alloy or the like.

The shaft portion 7*b* is projected toward a lower area of the second relay connecting portion 5 through the shaft portion receiving hole 5*a* formed in the second relay connecting portion 5. A lower end of the shaft portion 7*b* is connected to the control mechanism 8 through an insulating rod 12. The shaft portion 7*b* is made of stainless steel or the like.

The control mechanism 8 uses an air cylinder. The control mechanism 8 is installed in a control mechanism housing portion 13. An upper end of the control mechanism housing portion 13 is connected to the second cylinder member 2*b* through a connecting member 14.

In the following, the bellows 11 will be described. As is mentioned hereinabove, the bellows 11 is of a double construction type including the hermetically sealing inner bellows 11*a* and the current carrying outer bellows 11*b*.

The hermetically sealing bellows 11*a* is arranged at an outer circumferential side of the shaft portion 7*b* of the movable member 7 while surrounding the shaft portion 7*b*. The hermetically sealing bellows 11*a* has one end connected to the second relay connecting portion 5 and the other end connected to the flange portion 7*a* of the movable member 7.

The hermetically sealing bellows 11*a* has a hermetically sealing performance that prevents outside air from entering the interior of the first cylinder member 2*a* through the shaft portion receiving hole 5*a*. The hermetically sealing bellows 11*a* is made of a hermetically sealing material.

The current carrying bellows 11*b* is arranged around the hermetically sealing bellows 11*a*. Like the hermetically sealing bellows 11*a*, the current carrying bellows 11*b* has one end connected to the second relay connecting portion 5 and the other end connected to the flange portion 7*a*.

The current carrying bellows 11*b* electrically connects the movable member 7 and the second relay connecting portion 5. The current carrying bellows 11*b* is made of electrically conductive material.

In the embodiment shown in FIG. 1, the insulating cylinder 2 is divided into the first and second cylinder members 2*a* and 2*b*, and the second relay connecting portion 5 is tightly sandwiched between these two cylinder members 2*a* and 2*b*. However, if desired, a modification may be employed in which the insulating member 2 is constructed by only the first cylinder member 2*a* without usage of the second cylinder member 2*b* and the first relay connecting portion 4 is arranged at one open end of the first cylinder member 2*a* and the second relay connecting portion 5 is arranged at the other open end of the member 2*a*. In this modification, the control mechanism housing portion 13 or the connecting member 14 is made of insulating material.

In the following, operation and effects of the above-mentioned vacuum relay 1 will be described. As is shown by a left-half part of FIG. 1, when the first and second contacts 3 and 6 are brought into contact with each other, an electrically connected condition is established in which the first relay connecting portion 4 and the second relay connecting portion 5 are electrically connected to each other through the movable member 7 and the current carrying bellows 11*b*.

When the movable member 7 is pulled down toward the control mechanism 8 from its position indicated in the left-half part of FIG. 1, the first contact 3 and the second contact 6 are separated from each other as is indicated in the right-half part of FIG. 1, so that the electric connection between the first relay connecting portion 4 and the second relay connecting portion 5 is blocked.

Furthermore, when the movable member 7 is moved toward the first contact 3 by the control mechanism 8, the first contact 3 and the second contact 6 are brought into contact with each other as is indicated by the left-half part of FIG. 1, so that the first relay connecting portion 4 and the second relay connecting portion 5 take an electrically connected condition.

Figure 2:
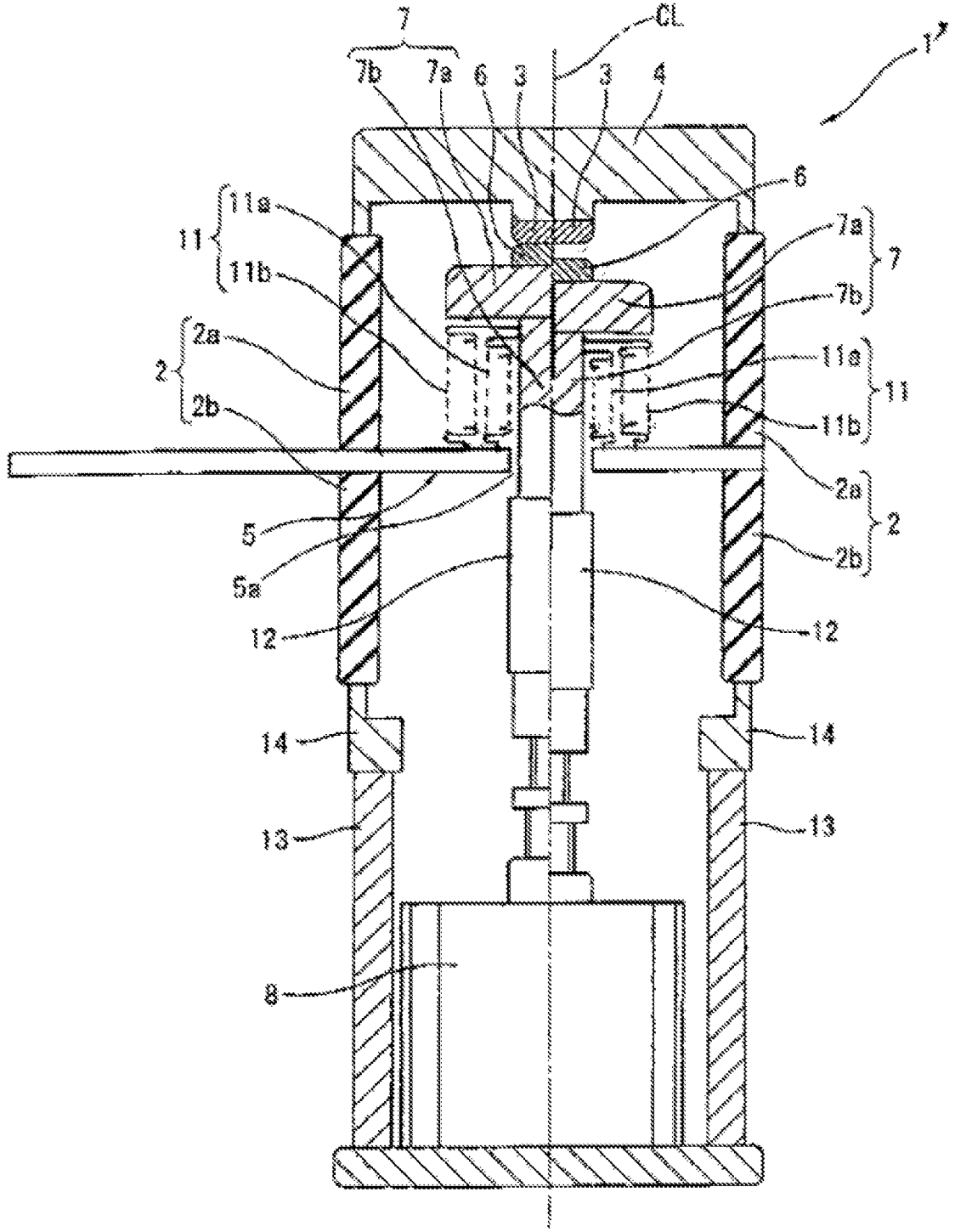
FIG. 2 is a sectional view of a sealed relay of the present invention, in which a movable member includes a flange portion and a shaft portion, the flange portion is constructed small in size as compared to FIG. 1, and a bellows is directly connected to the shaft portion. A left-half part from a center line CL shows a contact condition wherein first and second contacts are in contact with each other and a right-half part from the center line shows a non-contact condition wherein the first and second contacts are not in contact with each other.

In the above-mentioned embodiment, the current carrying is made by the current carrying outer bellows 11*b*, and thus, the current carrying outer bellows 11*b* is preferably made of high conductive material such as copper alloy or the like. While the hermetically sealing bellows 11*a* and the shaft portion 7*b* of the movable member 7 may be made of low conductive material such as stainless steel or the like. Furthermore, in case wherein the flange portion 7*a* of the movable member 7 is constructed small in size and the bellows is directly connected to the shaft portion 7*b* (see vacuum relay 1' of FIG. 2), it is preferable to use a high conductive material for producing the shaft portion 7*b*. Furthermore, as is mentioned hereinabove, an arrangement may be employed in which the second relay connecting portion 5 is arranged at the other open end of the insulating cylinder 2 and the control mechanism housing portion 13 and the connecting member 14 are made of insulating material.

EXPLANATION OF REFERENCE NUMERALS

1 . . . sealed relay
2 . . . insulating cylinder
3 . . . first contact
4 . . . first relay connecting portion
5 . . . second relay connecting portion
6 . . . second contact
7 . . . movable member
7*a* . . . flange portion
7*b* . . . shaft portion
8 . . . control mechanism
11 . . . bellows
11*a* . . . inner bellows (hermetically sealing bellows)
11*b* . . . outer bellows (current carrying bellows)

The invention claimed is:

1. A sealed relay comprising:

an insulating cylinder;

a first relay connecting portion connected to a first open end of the insulating cylinder to hermetically close the first open end, the first relay connecting portion having a first contact on an inner surface of the first relay connecting portion;

a second relay connecting portion connected to the insulating cylinder in a manner to face the first relay connecting portion leaving a given distance therebetween, the second relay connecting portion extending through the insulating cylinder;

a movable member movably arranged between the first relay connecting portion and the second relay connecting portion, the movable member having a second contact configured to contact the first contact when the movable member is moved toward the first relay connecting portion;

a control mechanism configured to move the movable member in a first direction to establish the contact between the first contact and the second contact and a second direction to break the contact between the first contact and the second contact; and a bellows provided between the movable member and the second relay connecting portion to electrically connect the movable member and the second relay connecting portion, such that the first relay connecting portion and the second relay connecting portion are configured to become electrically connected through the movable member when the first contact and the second contact are in contact, wherein the bellows is of a double structure type including an inner bellows and an outer bellows, the inner bellows having a hermetically sealing function to prevent outside air from entering into a space that is defined by at least the first relay connecting portion, the insulating cylinder and the inner bellows, the outer bellows having a current carrying function to electrically connect the movable member to the second relay connecting portion, the movable member comprises a circular flange portion that carries thereon the second contact and a shaft portion extending from the circular flange portion toward the control mechanism, the shaft portion configured to be axially moved by the control mechanism, and each of the inner bellows and the outer bellows has a first end directly connected to the shaft portion of the movable member and a second end connected to the second relay connecting portion.

2. The sealed relay as claimed in claim 1, wherein the inner bellows is arranged to keep an interior of the insulating cylinder in a vacuum condition.

3. The sealed relay as claimed in claim 1, wherein the control mechanism is placed at a position opposite to the movable member with respect to the second relay connecting portion.

4. The sealed relay as claimed in claim 1, wherein contact between the first contact and second contact turns on the sealed relay, and non-contact between the first contact and second contact turns off the sealed relay.

5. The sealed relay as claimed in claim 1, wherein the control mechanism comprises an air cylinder.

6. The sealed relay as claimed in claim 1, wherein the control mechanism comprises an air cylinder configured to drive the shaft portion.

7. The sealed relay as claimed in claim 1, wherein the shaft portion has a diameter smaller than a diameter of the circular flange portion.

8. The sealed relay as claimed in claim 7, wherein the second contact is provided at a center of an upper surface of the circular flange portion of the movable member, and the shaft portion is provided at a center of a lower surface of the circular flange portion of the movable member.

9. The sealed relay as claimed in claim 7, wherein the circular flange portion of the movable member is disposed above the second relay connecting portion, and the shaft portion of the movable member is received within a receiving hole formed in the second relay connecting portion.

10. The sealed relay as claimed in claim 1, wherein the first relay connecting portion comprises a circular plate.

11. The sealed relay as claimed in claim 1, wherein the insulating cylinder is divided into a first insulated cylinder member and a second insulated cylinder member by the second relay connecting portion.

12. The sealed relay as claimed in claim 11, wherein the second relay connecting portion is sandwiched between the first insulated cylinder member and the second insulated cylinder member.

13. The sealed relay as claimed in claim 1, wherein the second relay connecting portion is connected to a second open end of the insulating cylinder.

14. The sealed relay as claimed in claim 1, wherein the circular flange portion of the movable member is comprised of copper alloy, and the shaft portion of the movable member is comprised of stainless steel.

15. The sealed relay as claimed in claim 1, further comprising:

a housing portion configured to house the control mechanism; and a connecting member configured to connect the housing portion to the insulating cylinder.

16. The sealed relay as claimed in claim 1, wherein the circular flange portion of the movable member is comprised of a first material that is conductive, and the shaft portion of the movable member is comprised of a second material that is different from the first material.

* * * * *